US005748068A

United States Patent [19]

Kiyota

[11] Patent Number: 5,748,068

[45] Date of Patent: May 5, 1998

[54] FUSE BOX

[75] Inventor: Hirotaka Kiyota, Shizuoka, Japan

[73] Assignee: Yazaki Corporation, Tokyo, Japan

[21] Appl. No.: 769,828

[22] Filed: Dec. 20, 1996

[30] Foreign Application Priority Data

Dec. 20, 1995 [JP] Japan ..... 7-331903

[51] Int. Cl.[6] ..... H01H 85/22

[52] U.S. Cl. ..... 337/208; 337/186; 337/187; 337/188; 439/622

[58] Field of Search ..... 337/208, 186, 337/187, 188, 194, 197, 198, 213; 361/622, 626, 642, 833, 837, 835; 439/250, 620, 621, 622, 892, 893

[56] References Cited

U.S. PATENT DOCUMENTS

| | | | |
|---|---|---|---|
| 5,038,050 | 8/1991 | Minoura | 307/10.1 |
| 5,345,211 | 9/1994 | Muramatsu et al. | 337/186 |

FOREIGN PATENT DOCUMENTS

| | | | |
|---|---|---|---|
| 4-23048 | 2/1992 | Japan | H01H 85/22 |
| 4-59044 | 5/1992 | Japan | H01H 85/00 |
| 6-17343 | 5/1994 | Japan | H05K 7/00 |
| 6-36188 | 5/1994 | Japan | H01H 85/22 |

*Primary Examiner*—Leo P. Picard
*Assistant Examiner*—Anatoly Vortman
*Attorney, Agent, or Firm*—Sughrue, Mion, Zinn, Macpeak & Seas, PLLC

[57] ABSTRACT

A fuse-box which is reduced in size and which is designed so that the electric cable extends straight from the fuse-box. In the box body (21), a fuse-receiving portion (3) is provided in an upper surface of the box body (21) and electric-cable-end receiving portions (10) are produced in a lower surface of the box body (21). Further, screwing opening portions (8) are provided in opposite sides of the box body (21) so that a round terminal (17), connected to an electric cable (16) and disposed in the electric-cable-end receiving portion (10), is fixedly tightened to a screw-driven terminal (7) of the fuse (2) in the fuse-receiving portion (3) by a screw member (18). Further, an electric cable-fixing member (32) is provided so as to extend down from the box body (21) so that the electric cable (16), attached to the electric-cable-end receiving portion (10), is fixed vertically along the electric cable-fixing member (32). On the other hand, a lower cover (22) attached to the lower surface (24) of the box body (21) has electrically insulating covers (12) for covering the screwing opening portions (8), and a bottom wall portion (5) having an electric cable lead-out opening (36) through which the electric cable (16) passes to the outside.

8 Claims, 7 Drawing Sheets

FIG. 2
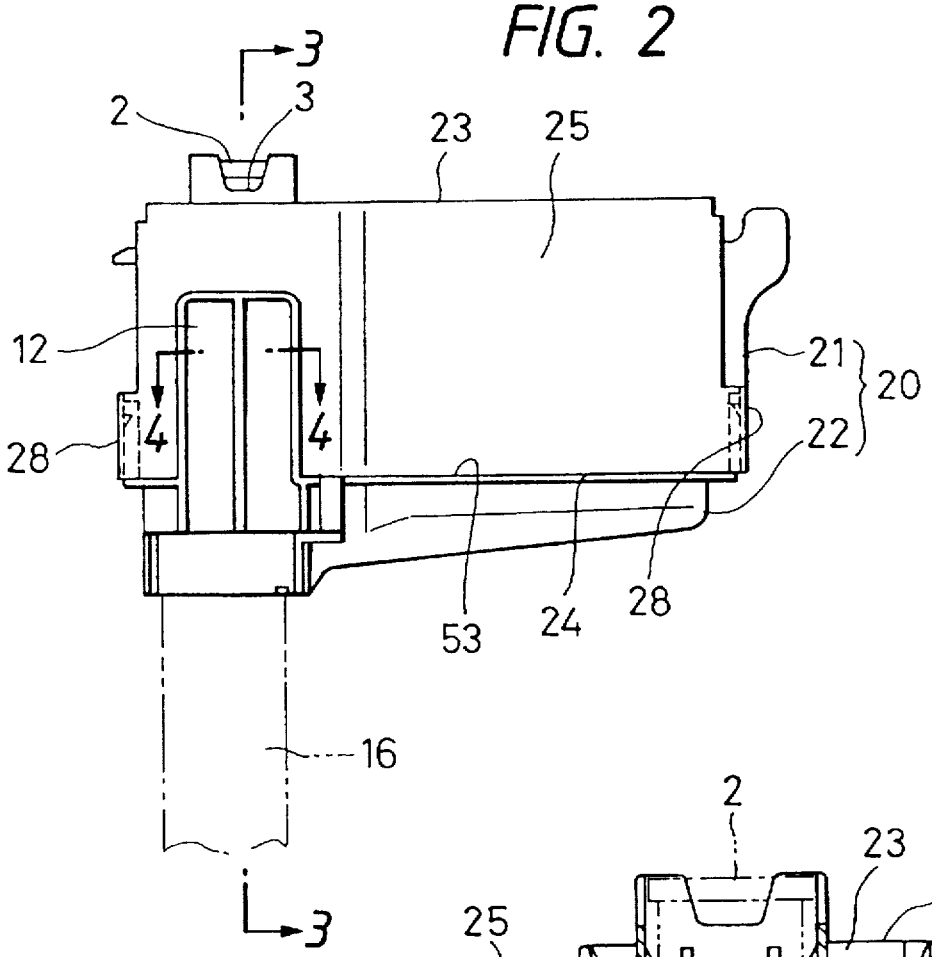
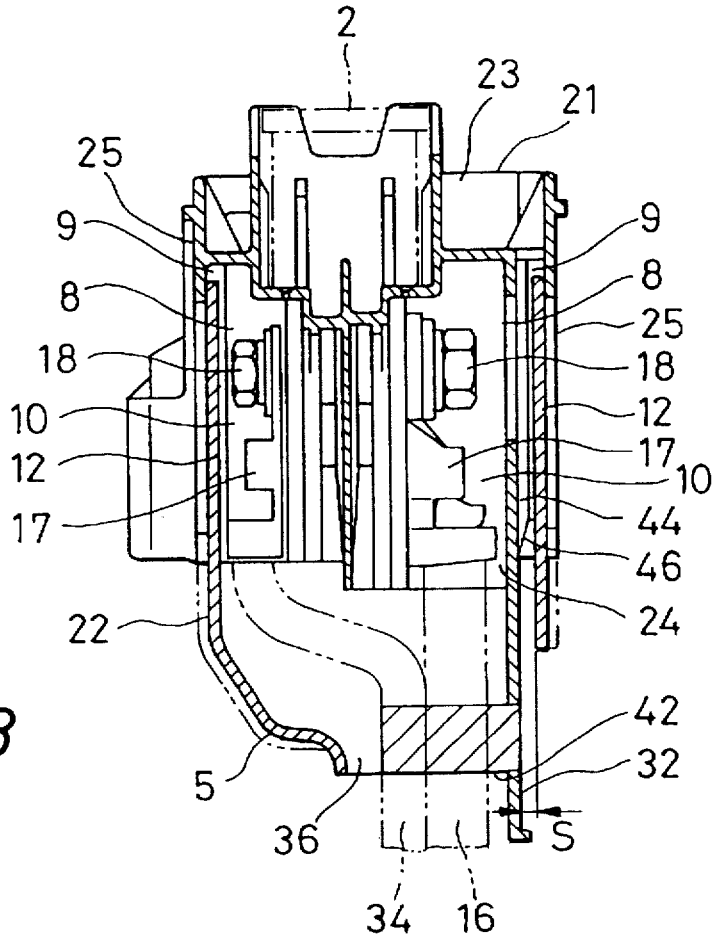
FIG. 3

FIG. 10
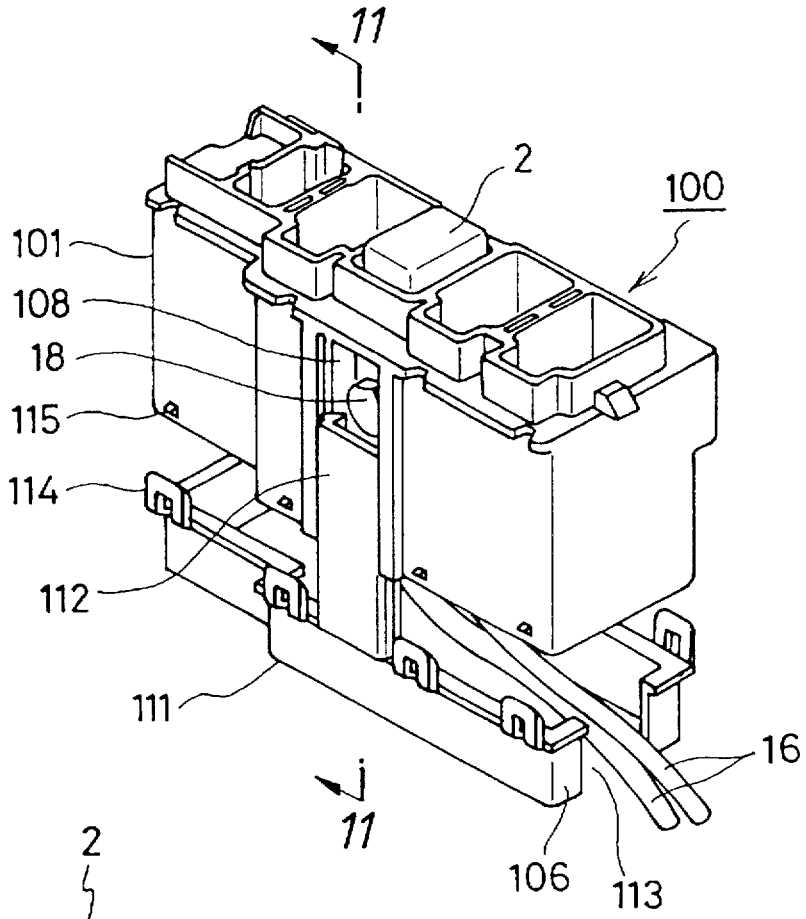
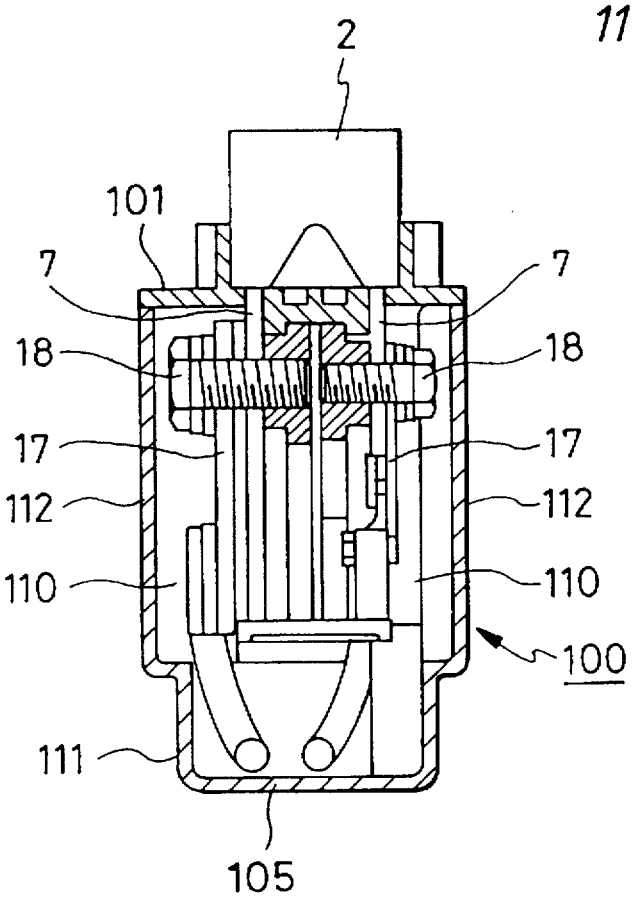
FIG. 11

FUSE BOX

BACKGROUND OF THE INVENTION

1. Field of the Invention

The present invention relates to a fuse-box and, more particularly, to a fuse-box adapted for use in an electric car, in which a large-current fuse having screw-driven terminals is received and electrically connected to a round terminal which is connected to a large-current electric cable.

2. Related Art

A fuse-box disclosed in JU-A-4-23048 will be described as an example of a conventional fuse-box with reference to FIGS. 9 through 11. The fuse-box 100 comprises a box body 101 formed from an electrically insulating resin, and a lower cover 111 formed from an electrically insulating resin and positioned under a lower surface of the box body 101.

The box body 101 includes a fuse-receiving portion 103 having an opening for receiving a fuse 2 therein; electric-cable-end receiving portions 110 formed at a lower portion of the box body 101 for receiving round terminals 17, connected to large-current electric cables 16, in such a manner as to be superimposed on screw-driven terminals 7, respectively, of the fuse 2 mounted on the fuse-receiving portion 103; and screwing opening portions 108 formed in opposite sides of the box body 101 so that the two pairs of terminals 7 and 17 are tightly connected to each other by screw members 18, respectively.

The lower cover 111 includes a bottom wall portion 105; electrically insulating covers 112 extending upwardly from opposite side edges of the bottom wall portion 105 and having bent projection portions 119 at opposite side edges which are received in guide grooves 109 formed in the box body 101 to thereby close the screwing opening portions 108; and engagement members 114 which are engaged with engagement means 115 provided on the box body 101 so that the lower cover 111 is fixed to the box body 101.

In the fuse-box 100, the electric cables 16 which are connected to the round terminals 17 are bent so as to extend along the longitudinal direction of the box and be led out through an electric cable lead-out 113 provided at a rear side wall 106 of the lower cover 111 as shown in FIGS. 9 and 10.

The problem with this arrangement is as follows. The large-current electric cable 16 is very stiff so that it is difficult to bend the electric cable 16. As a result, it is difficult to fit the lower cover 111 to the box body 101, and excessive force acts on the screwing portions when the lower cover 111 is attached to the box body 101. Therefore, the depth of the lower cover 111 must be relatively large in order to permit the large bending radius of the electric cables 16. However, the overall size of the fuse-box 100 becomes prohibitively large.

Further, in the aforementioned fuse-box 100, if the width of the electric cable lead-out 113 is increased to minimize the rebound force due to the bending of the electric cable 16, there is a risk that water, or the like, will invade the fuse-box 100.

Taking the aforementioned circumstances into consideration, an object of the present invention is to provide a fuse-box in which the overall size of the fuse box is not increased and the cover can be securely and easily attached to the box body.

SUMMARY OF THE INVENTION

To achieve the foregoing object, the fuse-box according to the present invention comprises: a box body in which connection terminals connected to electric cables are received in electric-cable-end receiving portions formed by opening a lower surface of the box body and in which the connection terminals are tightly fixed to terminals of a fuse mounted on a fuse-receiving portion by screw members through screwing opening portions opened in opposite sides of the box body; and a lower cover including a bottom wall portion for covering the lower surface of the box body, and electrically insulating covers engaged into guide grooves formed in the box body to thereby cover the screwing opening portions, respectively. An electric cable-fixing member for fixing the electric cables connected to the connection terminals so as to dispose the electric cables vertically along the electric cable-fixing member extends down from the box body while facing the screwing opening portion. Additionally, the electric cable-fixing member and an electric cable lead-out, through which the electric cables fixed to the electric cable-fixing member are passed, are disposed in the bottom wall portion of the lower cover.

Preferably, in the aforementioned fuse-box, each of the electrically insulating covers is provided in a circumferential wall portion of the lower cover so as to be able to be opened/closed by a hinge so that the electric cable lead-out is opened in a side of the lower cover when the electrically insulating cover is opened.

Preferably, in the aforementioned fuse-box, the electric cable-fixing member is disposed so as to face the electrically insulating covers through a space formed between the electric cable-fixing member and the electrically insulating covers when the lower cover is attached to the box body.

Further, in the aforementioned fuse-box, a positioning rib is provided on an outer surface of the electric cable-fixing member so as to be project therefrom so that the positioning rib abuts on a rear surface of the electrically insulating cover when the lower cover is attached to the box body, thereby positioning the electrically insulating cover in a position where the electrically insulating cover is engaged into the guide grooves of the box body for guiding the electrically insulating cover into the screwing opening portion.

Also, in the aforementioned fuse-box, the rib is provided so that not only an end portion on a side in which the electrically insulating cover is engaged into is formed as an inclined surface but also the rib is extended over the screwing opening portion.

In the aforementioned configuration of the present invention, the screw-driven terminals of the fuse are tightly connected to the connection terminals of the ends of the electric cables by the screw members inserted into the screwing opening portions in the sides of the box body after the fuse is attached to the fuse-receiving portion on the upper surface of the box body in a state in which the lower cover is removed from the box body. Additionally, the connection terminals of the electric cable ends are received in the electric-cable-end receiving portions in the lower surface of the box body, so that the electrical connection between the fuse and the electric cables is completed.

When the lower cover has been attached to the lower surface of the box body, assembling of the fuse-box is completed. An electric cable lead-out is provided in the bottom wall portion of the lower cover so as to face the screwing opening portions. Accordingly, the electric cables having connection terminals fixed into the box body are inserted into the electric cable lead-out and led out to the outside in a state in which the electric cables extend straight from the fixture position of the electric cables in the box body.

That is, because it is unnecessary to receive the electric cable in the lower cover in a state in which the electric cables are bent, the depth of the lower cover can be selected to be small so that the bottom wall portion of the lower cover can be moved up to be a position nearer the lower surface of the box body.

Furthermore, because the electric cables are not received in a state in which the electric cables are bent, the fitting of the lower cover to the box body can be made positively. Furthermore, because a bundle of electric cables is fixed to the electric cable-fixing member and extend straight, the inner diameter of the electric cable lead-out can be minimized so as to be nearly equal to the diameter of the electric cable bundle.

Further, if each of the electrically insulating covers of the lower cover is provided so as to be able to be opened/closed by a hinge so that the electric cable lead-out is opened in the side when the electrically insulating cover is opened, the electric cables can be easily inserted into the lower cover even after the connection terminals are fixed to the box body.

Further, if the electric cable-fixing member is disposed so that it is opposite to the electrically insulating cover and so that a space is secured between the electric cable-fixing member and the electrically insulating cover when the lower cover is fitted to the box body, not only electric cables having connection terminals fixed to the box body can be easily fixed to the electric cable-fixing member by a method of tape-winding, or the like, but also the expansion of the tape on the surface of the electric cable-fixing member due to the tape-winding can be accommodated into the space so that the sliding operation of the electrically insulating cover along the electric cable-fixing member can be done easily.

Further, if a positioning rib is provided on the outer surface of the electric cable-fixing member so that the positioning rib abuts on the rear surface of the electrically insulating cover when the lower cover is fitted to the box body, thereby positioning the electrically insulating cover to be fitted into the guide grooves of the box body, the electrically insulating cover can be fitted to the guide grooves rapidly while correcting the warp of the electrically insulating cover simply by pushing the surface of the electrically insulating cover against the lower surface of the box body so that the rear surface of the electrically insulating cover abuts on the rib when the lower cover is attached to the box body even in the case where the warp of the electrically insulating cover is caused by distortion, or the like, at the time of molding.

BRIEF DESCRIPTION OF THE DRAWINGS

FIG. 2 is a front view showing an assembly state of the fuse-box depicted in FIG. 1;

FIG. 3 is a sectional view taken along the line 3—3 in FIG. 2;

FIG. 10 is a perspective view showing a state in which the conventional fuse-box is to be assembled; and FIG. 11 is a sectional view taken along the line 11—11 in FIG. 10.

DETAILED DESCRIPTION OF THE INVENTION

A preferred embodiment of the fuse-box according to the present invention will be described below in detail with reference to the drawings.

Figure 1:
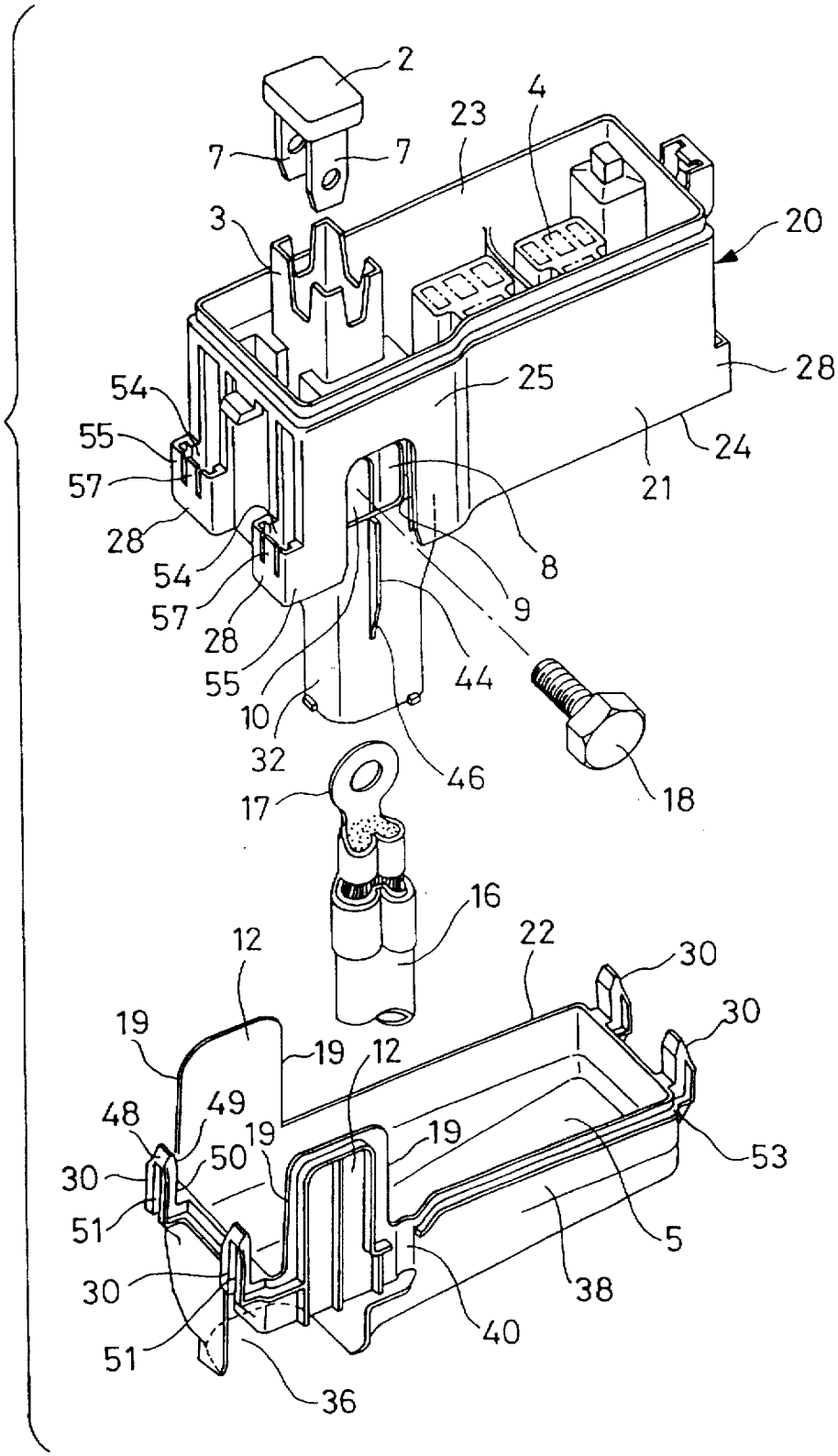
FIG. 1 is an exploded perspective view showing an embodiment of the fuse-box according to the present invention.
Figure 4:
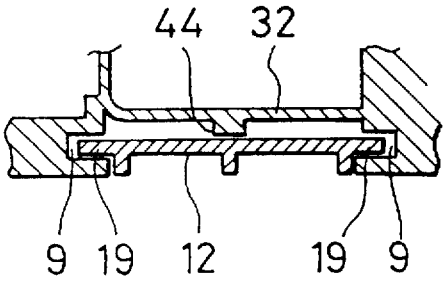
FIG. 4 is a sectional view taken along the line 4—4 in FIG. 2.
Figure 5:
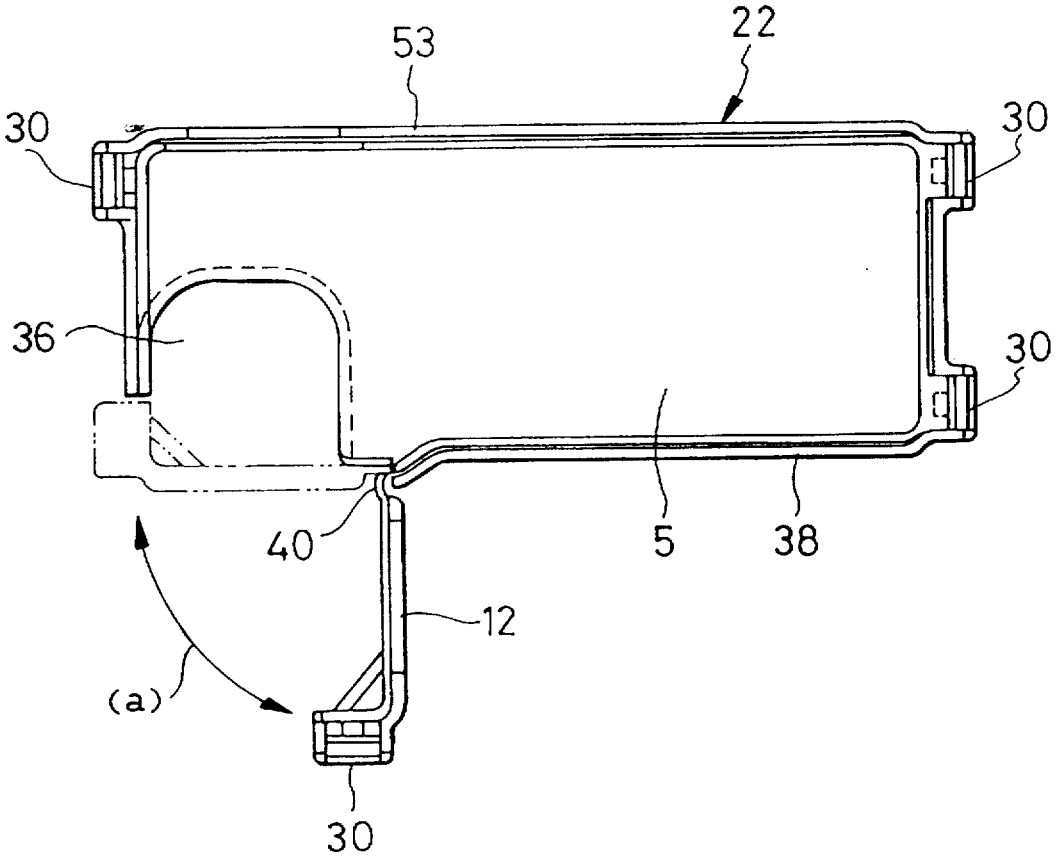
FIG. 5 is a plan view showing the structure of the lower cover of the fuse-box.
Figure 6:
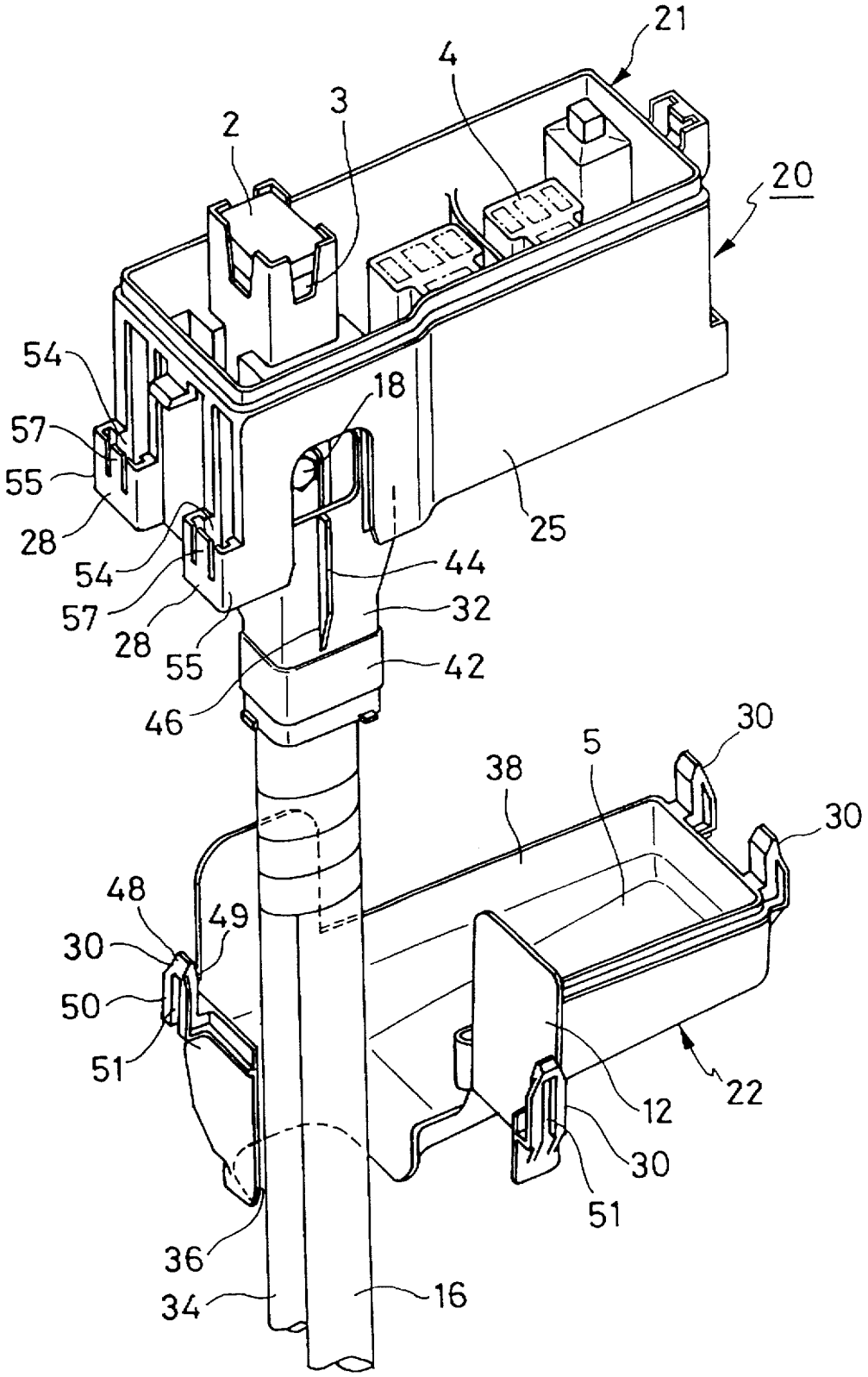
FIG. 6 is a perspective view showing a state in which the fuse-box is to be assembled.
Figure 7:
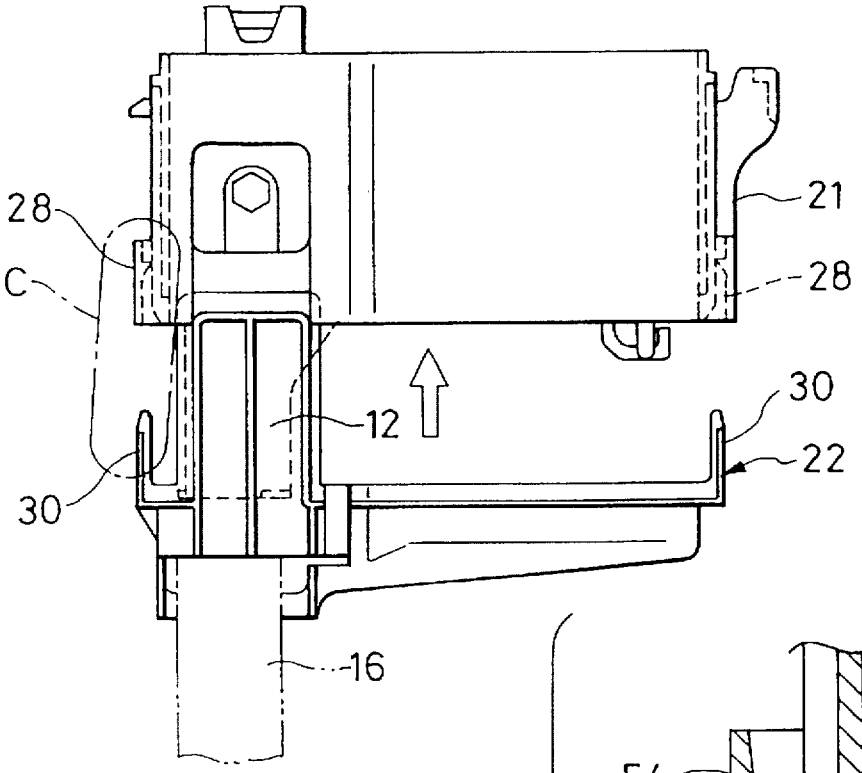
FIG. 7 is a front view showing a state in which the fuse-box is to be assembled.
Figure 8:
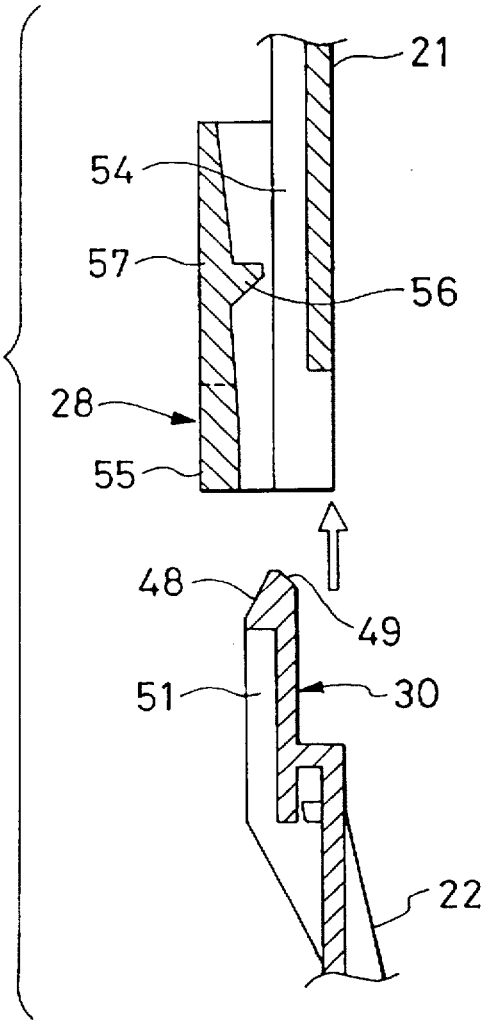
FIG. 8 is a detailed view of the portion C in FIG. 7.
Figure 9:
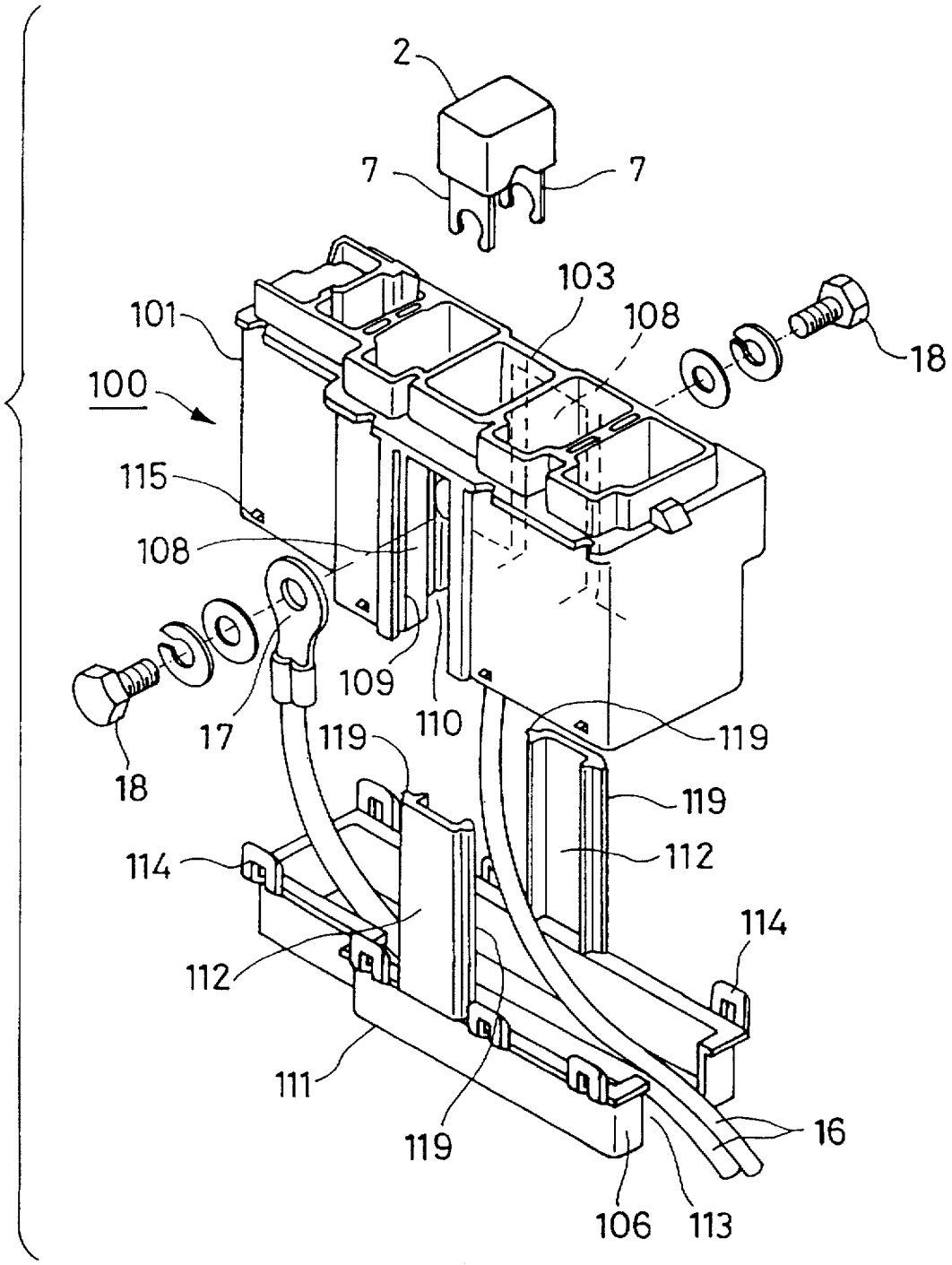
FIG. 9 is an exploded perspective view of a conventional fuse-box.

FIG. 1 is an exploded perspective view showing an embodiment of the fuse-box according to the present invention; FIG. 2 is a front view showing an assembly state of the fuse-box; FIG. 3 is a sectional view taken along the line 3—3 in FIG. 2; FIG. 4 is a sectional view taken along the line 4—4 in FIG. 2; FIG. 5 is a plan view showing the structure of a lower cover; FIG. 6 is a perspective view showing a state in which the fuse-box is to be assembled; FIG. 7 is a front view showing a state in which the fuse-box is to be assembled; and FIG. 8 is a detailed view of the portion C in FIG. 7.

The fuse-box 20 comprises a box body 21 formed from an electrically insulating resin, and a lower cover 22 also formed from an electrically insulating resin and disposed so as to cover the bottom of the box body 21.

The box body 21 includes an upwardly exposed fuse-receiving portion 3 for receiving a large-current fuse 2, having a pair of screw-driven terminals 7, as well as upwardly exposed mount portions 4 for mounting relays and other electric appliances. Additionally, the box body includes an electric-cable-end receiving portion 10 for receiving a screw connection terminal (round terminal) 17 connected to an end of a large-current large-diameter electric cable 16. The cable-end receiving portion is provided so as to be opened in a lower surface 24 of the box body 21.

The round terminal 17 inserted in the electric-cable-end receiving portion 10 contacts the screw-driven terminal 7 of the fuse 2 received in the fuse-receiving portion 3 and is tightly fixed to the electric-cable-end receiving portion 10 by a screw member 18 received in opening portions 8 formed in opposite side surfaces of the box body 21.

The lower cover 22 includes a bottom wall portion 5 for covering the lower surface 24 of the box body 21; electrically insulating covers 12 having projection portions 19 which extend upwardly from side edges of the bottom wall portion 5 for covering the opening portions 8 in a state in which the projection portions 19 are fitted into guide grooves 9 formed in an outer wall 25 of the box body 21; and fitting pieces 30 engaged with fitting means 28 provided on the box body 21 to thereby fixedly connect the lower cover 22 to the box body 21.

In this embodiment, an electric cable-fixing member 32 for collectively vertically supporting and fixing the largest-diameter electric cable 16 attached to the electric-cable-end receiving portion 10 and the other electric cable 34 attached to the box body 21 is provided so as to extend down facing the screwing opening portions 8.

Further, in the bottom wall portion 5 of the lower cover 22, corresponding to the direction in which the largest-diameter electric cable 16 extends outwardly, an electric cable lead-out opening 36 is provided through which the electric cables 16 and 34 pass.

As shown in FIG. 5, each of the electrically insulating covers 12 of the lower cover 22 is pivotable in the direction of the arrow (A) by a hinge 40 formed by reducing the thickness of a circumferential wall portion 38 of the lower cover 22. In a state in which the electrically insulating cover 12 is opened, the electric cable lead-out opening 36 of the lower cover 22 is opened in the side of the lower cover 22 as shown in FIG. 6.

Further, the electric cable-fixing member 32 is disposed so as to oppose the electrically insulating cover 12 so when the box body 21 is attached to the lower cover 22. As shown in FIG. 31 a space S is provided between the electric cable-fixing member 32 and the electrically insulating cover 12. The width of the space S is determined by the lateral position of the guide grooves 9 into which the projection portions 19 on the opposite side edges of the electrically insulating cover 12 are slidably fitted. The space is provided to allow for tape 42 to be wound around the electric cable-fixing member 32, as shown in FIG. 3.

Also as shown in FIG. 4, a positioning rib 44 is provided on the outer surface of the electric cable-fixing member 32 so as to project therefrom in the position where the positioning rib 44 abuts on the rear surface of the electrically insulating cover 12 and the opposite-side-edge projection portions 19 of the electrically insulating cover 12 are engaged into the guide grooves 9 of the box body 21 when the lower cover 22 is attached to the box body 21.

As shown in FIG. 1, the bottom portion of the rib 44, has an inclined surface 46 to facilitate insertion of the electrically insulating cover 12 onto the box body (i.e., the cover slides on the rib 44 easily).

As shown in FIGS. 1 and 8, each of the fitting pieces 30, projecting from the upper-end-side four corners of the lower cover 22, includes a lock groove 51 in the front surface of an elastic projection piece 50 having taper surfaces 48 and 49 formed by reducing the plate thickness gradually toward its top end.

On the other hand, the fitting means 28 are provided on the box body 21 in positions corresponding to the fitting pieces 30 respectively so that the fitting pieces 30 engage with the fitting means 28, respectively. As shown in FIGS. 1 and 8, each of the fitting means 28 is formed in such a manner that a frame wall 55, forming a projection-piece-insertion portion 54 into which the elastic projection piece 50 can be inserted, is partially cut to form an elastic piece 57 having a projection 56 which is engaged into the lock groove 51 of the fitting piece 30.

In the aforementioned fuse-box 20, in a state in which the lower cover 22 is removed from the box body 21 as shown in FIG. 6, the fuse 2 is attached to the fuse-receiving portion on the upper surface 23 of the box body 21. Additionally, at the same time, the round terminal 17 at end of the electric cable 16 is inserted into the electric-cable-end receiving portion 10 at the lower surface 24 of the box body 21. Therefore, the screw-driven terminal 7 of the fuse 2 is fixedly tightened to the round terminal 17 by the screw member 18 inserted through the screwing opening portion 8 of the box body 21. Thus, the electrical connection between the fuse 2 and the electric cable 16 is completed.

After other electric cables 34 are attached to the electric appliance mount portions 4 of the box body 21 in the same manner as described above, all the electric cables 16 and 34 are bundled, wound with the tape 42 and fixed to the electric cable-fixing member 32 so as to run vertically along the electric cable-fixing member 32.

After the attachment of the electric cables 16 and 34 to the electric cable-fixing member 32 is completed, the is electric cable bundle extending down from the electric cable-fixing member 32 is inserted into the electric cable lead-out 36 of the lower cover 22 in a state in which the electrically insulating cover 12 is opened as shown in FIG. 6. Thereafter, the electrically insulating cover 12 is closed as shown in FIG. 7 and the lower cover 22 is pushed up toward the box body 21. If the lower cover 22 is forced toward the box body 21 while pushing the electrically insulating cover 12 from above so that the rear surface of the electrically insulating cover 12 abuts on the positioning rib 44 after the top end of the electrically insulating cover 12 is superimposed on the electric cable-fixing member 32, the respective fitting pieces 30 of the lower cover 22 are engaged with the respective fitting means 28 of the box body 21 as shown in FIG. 2 and the lower cover 22 is fixedly connected to the lower surface of the box body 21. Thus, the assembly is completed.

Incidentally, simultaneously to when the respective fitting pieces 30 of the lower cover 22 are engaged with the respective fitting means 28 of the box body 21, a butt flange surface 53 (FIG. 1), provided on the circumferential wall portion 38 of the lower cover 22 so as to project therefrom, abuts on the lower end surface of the outer wall 25 of the box body 21 so that the lower cover 22 cannot be pushed any further.

As described above, in the fuse-box 20 of the aforementioned embodiment, the electric cable lead-out opening is 36 is provided in the bottom wall portion 5 of the lower cover 22 so that the electric cable 16, with its end fixed in the box body 21, is passed through the electric cable lead-out opening 36 and led out to the outside in a state in which the electric cable 16 extends from the fixture position in the box body 21.

That is, since it is unnecessary to receive the electric cable 16 in the lower cover 22 in a state in which the electric cable 16 is bent, the bottom wall portion 5 of the lower cover 22 can be moved up to a position closer to the lower surface 24 of the box body 21. Accordingly, the depth of the lower cover 22 can be reduced so that the size of the fuse-box 20 can be reduced as a whole.

Furthermore, in the configuration, the electric cable 16 is not received in the lower cover 22 in a state in which the electric cable 16 is bent, so that rebound force from the electric cable 16 received in the box does not act on the joint portion between the lower cover 22 and the box body 21. Accordingly, the joint portion can be prevented from being broken, or the like.

Furthermore, when the lower cover 22 is attached to the box body 21, the electric cables 16 and 34, extending down from the box body 21, are wound with tape 42 and fixed to the electric cable-fixing member 32 in advance. Accordingly, the electric cables 16 and 34 never interfere with the periphery of the lower cover 22 even in the case where the electric cables 16 and 34 are not being hold, and the work of attachment of the lower cover 22 to the box body 21 can be carried out smoothly so that excellent assembling property can be secured.

Furthermore, because the electrically insulating cover 12 of the lower cover 22 is provided so as to be able to be opened/closed by the hinge 40, the electric cable 16 can be inserted into the electric cable lead-out opening 36 easily even after the round terminal 17 is fixed to the box body 21. Accordingly, the assembling procedure is not limited, so that assembling property can be improved more greatly.

Furthermore, because the electric cable-fixing member 32 opposes the electrically insulating cover 12 when the lower cover 22 is attached to the box body 21 and because a space S required for winding the tape 42 in the electric cable-fixing member 32 is provided between the electric cable-fixing member 32 and the electrically insulating cover 12, not only can the electric cable 16 with its round terminal 17 fixed in the box body 21 by the screw members 18 be wound with the tape 42 and fixed to the electric cable-fixing member 32 but also the tape 42 expanded toward the surface of the electric cable-fixing member 32 does not interfere with the sliding operation of the electrically insulating cover 12.

Furthermore, the positioning rib 44 is provided on the front surface of the electric cable-fixing member 32 so as to project therefrom in the position where the positioning rib 44 abuts on the rear surface of the cover 12, and the electrically insulating cover 12 is engaged into the guide grooves 9 of the box body 21, when the lower cover 22 is attached to the box body 21. Accordingly, even in the case where warp is caused by distortion, or the like, in the electrically insulating cover 12 at the time of molding, the projection portions 19 of the electrically insulating cover 12 can be fitted into the guide grooves 9 of the box body 21 rapidly while correcting the warp of the electrically insulating cover 12 simply by pushing the lower cover 22 against the lower surface 24 of the box body 21 in a state in which the electrically insulating cover 12 is pushed from its surface side. Accordingly, the lower cover 22 can be attached to the box body 21 easily and securely.

Incidentally, the specific configuration of the fitting means 28 and the fitting pieces 30 for connecting/fixing the box body 21 and the lower cover 21 to each other is not limited to the aforementioned embodiment.

Although the aforementioned embodiment has described upon the case where each electrically insulating cover 12 provided on the lower cover 22 is formed so as to be able to be opened/closed by the hinge 40, it is not always necessary that the electrically insulating cover 12 can be opened/closed. For example, the same effect can be obtained also by such a configuration that the lower cover 22 has a circumferential wall portion 38 opened in the side of the electric cable lead-out 36 opening.

We claim:

1. A fuse-box comprising:

a box body including a fuse receiving portion for receiving a fuse having fuse terminals extending therefrom, a bottom portion of said box body having a bottom opening for receiving at least one connection terminal connected to a cable, and opposite side portions of said box body each having a side opening through which a screw is insertable for interconnecting said connection terminal to one of said fuse terminals;

a lower cover for covering said bottom opening and said side openings after said terminals have been interconnected, said lower cover including a bottom surface which covers said bottom opening, and opposing side covers for covering each said side opening; and a cable fixing member projecting downwardly from said box portion, wherein said cable extends downwardly from said box body through a cable lead-out opening provided in said bottom surface of said lower cover, and wherein said cable is secured to said cable fixing member.

2. The fuse box of claim 1, wherein each said side cover is pivotally secured to said lower cover so as to be pivotable from a closed position to an opened position to define a side opening in said lower cover which is continuous with said cable lead-out opening, wherein said cable can be passed through said side opening so as to extend through said cable lead-out opening.

3. The fuse box of claim 2, wherein each said side cover is provided in a circumferential wall of said lower cover.

4. The fuse box of claim 1, wherein said cable fixing member opposes said side cover when said lower cover is secured to said box body so as to define a space therebetween.

5. The fuse box of claim 4, further comprising a positioning rib provided on an outer surface of said cable-fixing member, said positioning rib abutting against an inside surface of one of said side covers upon attachment of said lower cover to said box body.

6. The fuse box of claim 5, wherein each said side cover is slidably received in grooves provided edges of said box body defining said side openings.

7. The fuse box of claim 5, wherein a bottom portion of said rib is tapered to define an inclined surface, said lower cover sliding along said inclined surface when said lower cover is slidably engaged with said box body.

8. The fuse box of claim 1, further comprising fixing means for fixing said lower cover to said box body.

* * * * *